US005398626A

United States Patent [19]

Rosso et al.

[11] Patent Number: 5,398,626

[45] Date of Patent: Mar. 21, 1995

[54] PROCESS AND DEVICE FOR PREPARING STOCKINGS FOR CLOSING THE TOE PORTION THEREOF

[75] Inventors: Pietro Rosso, Turin; Giancarlo Scanzi; Adriano Mazza, both of Borgo SanGiacomo; Rinaldo Chiodi, Villachiara, all of Italy

[73] Assignee: Rosso Industrie S.P.A., Orbassano, Italy

[21] Appl. No.: 122,579

[22] PCT Filed: Jan. 29, 1992

[86] PCT No.: PCT/EP93/00207

§ 371 Date: Sep. 29, 1993

§ 102(e) Date: Sep. 29, 1993

[87] PCT Pub. No.: WO93/15253

PCT Pub. Date: Aug. 5, 1993

[30] Foreign Application Priority Data

Jan. 29, 1992 [IT] Italy ..... TO92A0064

[51] Int. Cl.[6] ..... D05B 27/18; D04B 1/26

[52] U.S. Cl. ..... 112/121.15; 66/186

[58] Field of Search ..... 66/172 E, 185, 187; 112/121.15, 304, 308

[56] References Cited

U.S. PATENT DOCUMENTS

| | | | |
|---|---|---|---|
| 2,968,937 | 1/1961 | Margulies | 66/187 |
| 4,111,138 | 9/1978 | Rockerath et al. | 112/304 X |
| 4,655,150 | 4/1987 | Romano | 112/308 X |
| 4,957,051 | 9/1990 | Maegawa et al. | 112/121.15 X |
| 5,189,970 | 3/1993 | Van Duyne | 112/121.15 X |

*Primary Examiner*—John J. Calvert

*Attorney, Agent, or Firm*—Herbert Dubno; Yuri Kateshov

[57] ABSTRACT

A chain feeder for a looping machine for closing a toe portion of a stocking formed of elastic yarns includes two identical bars forming a slot therebetween for receiving a folded toe portion of the stocking to be sewn, each bar having a first segment starting at a distance after an inlet of the feeder and diverging downwards and passing into a second segment running parallel to the upper side of the bar, so that the first segments of the bars form a slanted plane interrupted by a slot receiving the stockings in which the finer rows of elastic yarn at the toe portion are gradually stretched upon advancing along the slot.

9 Claims, 5 Drawing Sheets

PROCESS AND DEVICE FOR PREPARING STOCKINGS FOR CLOSING THE TOE PORTION THEREOF

CROSS REFERENCE TO RELATED APPLICATIONS

This application is a national phase of PCT/EP 93/00207 filed 29 Jan. 1993 and based, in turn, upon Italian application TO 92 A 000 064 of 29 Jan. 1992 under the International Convention.

FIELD OF THE INVENTION

The present invention relates to a process for preparing stockings produced on circular knitting machine for sewing together or looping of the toe portion closed in a looping machine with a chain feeder. The invention relates further to a feeder for looping machines, wherein the toe portions of stockings prepared according to the process are closed.

BACKGROUND OF THE INVENTION

It is known that during so-called blind stitching, when not all stitches of the connecting row are picked up, the precisely aligned sliding of the stocking onto the feeder used to the fact that the difference between the fine row of stitches and the normal thickness of the stocking provides an adjusting stop against the underside of the guide ribs of the feeder.

If in coarser stockings this difference is considerable, in the case of fine stockings it can hardly be noticed ( e.g. stockings made with a diameter of 3¾ and 240 needles, or 3½ and 200 needles), so that straightness of the seam is uncertain and incidental.

It has therefore been proposed that the knit of the toe be ended with a row of wide stitches, reinforced by the addition of a second yarn, in order to raise the adjusting stop against the lower guide plane of the feeder. In this way the straightness of the seam is improved, but the result is still not adequate, particularly at the corners, because at the end of the decreasing toe portion the fine-stitch rows of elastic yarn are higher with respect to the middle part of the toe.

As a result, the quality of the seam varies greatly depending on the goods; it is best in stockings made of wool and acrylic, less good in stockings made of cotton. Besides the seam is larger, since it was made not only on rows of elastic yarn but also on a wide row reinforced with two yarns.

The above-described known system uses a feeder of special construction as equipment for the looping machine, wherein the toe portions of stocking prepared as above are closed. The construction is made possible by the development of a stocking guide feeder with chains, the thickness of the bars being increased to 8 mm and even 9 mm from the initial 4 mm.

A process for the preparation of stockings produced in circular knitting machines for the closing of the toe portion in looping machines with chain feeders can comprise the steps:

after knitting of a stocking is concluded, forming a row of wide stitches and subsequent rows of finer stitches of elastic yarn at a toe portion of the knitted stocking body;

forming subsequent rows of a yarn thicker than the one used for the stocking body in order to form a reinforced edge which rests from above against the upper sides with two bars of the feeder which are mirror images of one another and symmetrical with respect to a longitudinal median plane of the feeder forming a slot into which the flattened row of the stocking is inserted; and providing each bar with a longitudinal rib which is at a distance from the corresponding rib of the other bar and has an oblique segment starting at a distance from the inlet of the feeder and diverging downwardly with respect to the upper side of the respective bar so that a segment is formed which together with the opposite rib constitutes a slanted or inclined plane interrupted via a longitudinal slot, the oblique segment of each rib passing into a segment running parallel with the upper sides of the bars.

OBJECTS OF THE INVENTION

It is the object of the invention to provide a process for the preparation of stockings produced on circular knitting machines for the closing of the toe portion in looping machines with chain feeders, wherein the drawbacks of the state of the art are avoided. Another object is to provide a process whereby a better alignment of the stocking can should be achieved, primarily at the corners, so that a practically perfect, straight seam can be produced.

It is also an object to make the seam thinner and extremely secure.

Finally, an object is to provide a seam which has point by point a visible and touchable assimilation to the excellent traditional looping.

SUMMARY OF THE INVENTION

These objects are attained, in accordance with the invention by making a height of the wide stitch row greater than the thickness of the ribs of the bars and the sum of the height of the wide stitch row and the height of the fine rows, measured when the fabric is stitched, at most equal to the thickness of the bars. In this case, therefore, the rows of wide stitches are basically superposed in the folded stocking by gradually advancing the latter toward the slot interrupting the slanted plane, entering the slot approximately in the middle of the rib segments whereby they move as if they were guided on rails and the finer rows of the elastic yarn are gradually stretched.

In an advantageous further development of this process that the row of wide stitches follows a row of tight stitches made of the same yarn as the stocking. This measure has the advantage that in the area of the row with tight stitches a reinforcement with respect to the following row of wide stitches is obtained.

A chain feeder for a looping machine for closing the toe portion according to the invention can comprise:

two bars of the feeder which are mirror images of one another and symmetrical with respect to a longitudinal median plane of the feeder forming a slot into which the flattened row of the stocking is inserted; and providing each bar with a longitudinal rib which is at a distance from the corresponding rib of the other bar and has an oblique segment starting at a distance from the inlet of the feeder and diverging downwardly with respect to the upper side of the respective bar so that a segment is formed which together with the opposite rib constitutes a slanted or inclined plane interrupted via a longitudinal slot, the oblique segment of each rib passing into a segment running parallel with the upper sides of the bars.

In this system, according to the invention, the thickness of the ribs is smaller than the height of the wide stitches which are formed at the end of the stocking toe portion.

This feeder solves the problem in that the thickness of the guide ribs is smaller than the height of the wide stitches which are produced at the end of the stocking toe portion. The rib thickness is thereby preferably between 0.5 and 0.8 mm.

As a result of this measurement, when the folded stocking is introduced into the feeder wherein the distance between the bars has been properly set, the row with the wide stitches comes in over the slot onto the inclined plane formed by the ribs, so that the fine-stitch rows made of elastic yarn are stretched and the wide-stitch rows are guided through this slot by said ribs like on rails.

In a further feature of the invention, the two mutually facing sides of the toothed chain of the feeder are pressed by springs towards the longitudinal median plane of the feeder. In this way both layers of the stocking can be more accurately positioned when the stocking is introduced in the slot separating from each other the first segments of guide ribs, which project from the bars towards the median plane, because the fabric has the possibility to better adjust from both sides.

For stitching the rows of stitches made of elastic yarn, recesses are provided in the bars starting from the area at which the oblique segments of the guide ribs begin and open in the direction of the median longitudinal plane of the feeder. These recesses are upwardly covered by lamella of spring-steel band of a thickness of 0.3 to 0.4 mm and whose mutually-facing edges are aligned with the upper edges of the inner side walls of the bars.

This has the advantage that the fine-stitch rows of elastic yarn are always easier stretched, whereby the height difference between the fine-stitch rows on the side of the decreasing toe portion and the fine-stitch rows in the heel portion are evened out.

Means can be provided for setting the degree of elasticity of the lamellae.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
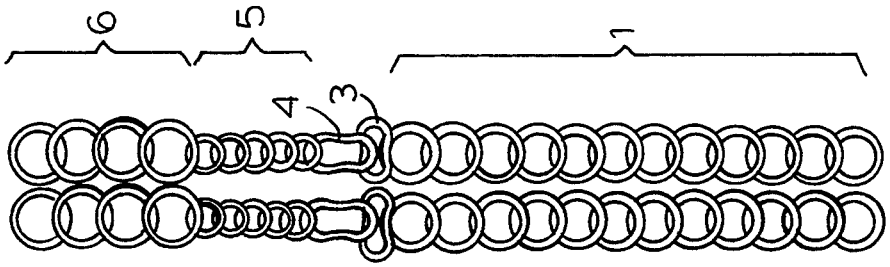
FIG. 2 is a diagram showing the orientation in the section plane II—II of FIG. 1.
Figure 1:
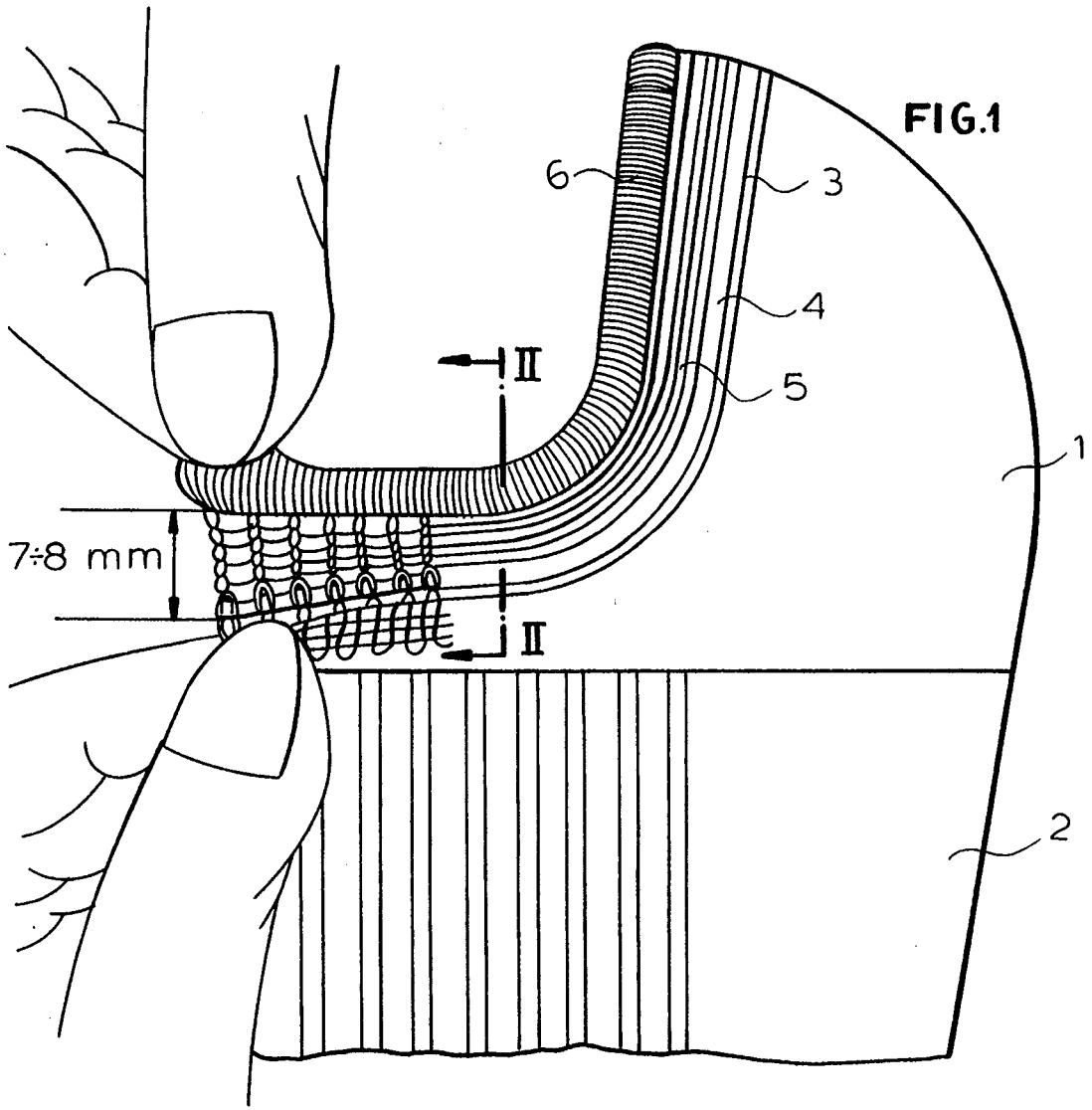
FIG. 1 is an elevational view of a stocking toe portion, shown highly diagrammatical which is prepared according to the invention for being sewn together in a looping machine provided with a chain feeder.
Figure 6:
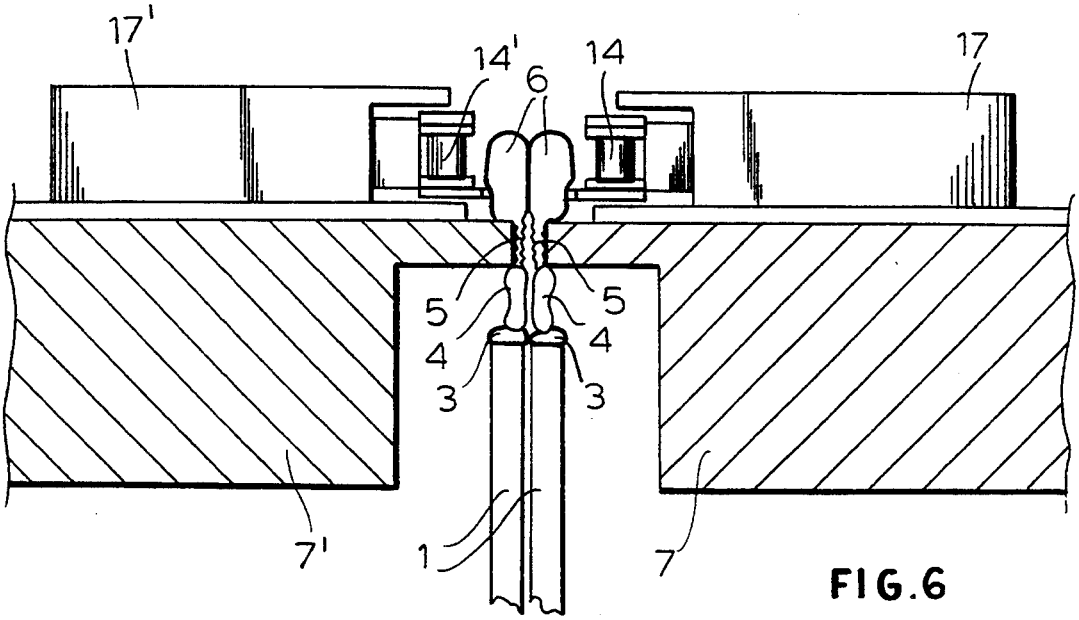
FIG. 6 is a sectional view in the plane VI—VI of FIG. 4.

As shown by the illustrated embodiment example of the invention, at the end of the stocking production on a circular knitting machine known per se, in the area of the round toe portion 1 of the actual stocking 2 (compare FIG. 1), a row of stitches 3 with very tight stitches is produced, followed by a row 4 with wide stitches succeeded in turn by a few small rows 5, for instance four or five rows of tight stitches of an elastic yarn. Immediately after these fine-stitch rows, based on a normal and known production method, further 10 to 12 rows of stitches are produced from a yarn thicker than the yarn of the stocking, so that a thickened or widened edge 6 is formed having the task to position the stocking on the feeder of the looping machine. In looking at the thickness of the stocking in FIG. 2, a widening can be noticed in the area of the stitch row 3 with very tight stitches, while in the area of row 4 with wide stitches, as well as of narrow rows 5 with tight stitches of elastic yarn a decrease in thickness can be noticed. This is very clearly apparent from the sectional views in FIGS. 2, 6 and 7. However, thereby it has to be taken into consideration that the illustrations in these figures, particularly the plaited texture in FIG. 2, are only of a diagrammatic nature because in reality the windings of the individual rows 1, 3, 4, 5 and 6 of the superposed two layers in the toe area of the actual stocking lie in a plane which is perpendicular to the plane of FIG. 2.

The feeder for feeding the stocking prepared according to the invention to the looping machine has, in a manner known per se, two bars 7 and 7', which are designed as mirror images of each other symmetrical with respect to the longitudinal median plane and are separated from each other by a slot 8. The length of slot 8 is selected so that when the superposed layers in the toe area of the stocking are inserted by hand into the inlet 9 (FIG. 3) of the feeder, the reinforced edges 6 rest on the upper-side edge segments close to each other of bars 7 and 7' (compare also FIG. 6).

Figure 3:
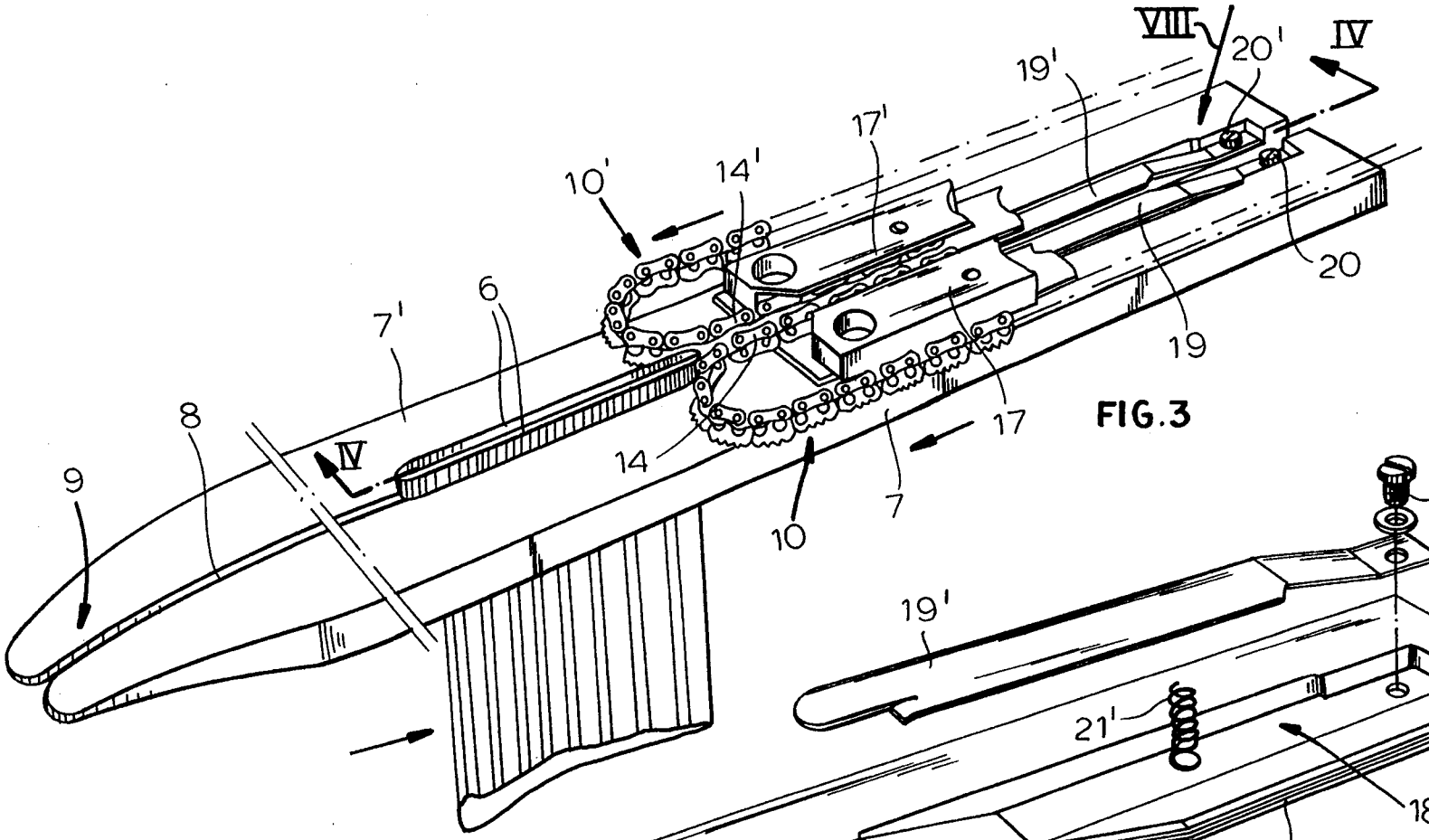
FIG. 3 is a perspective view of a chain feeder during the feeding of a toe portion of a stocking prepared according to the invention into a looping machine.
Figure 5:
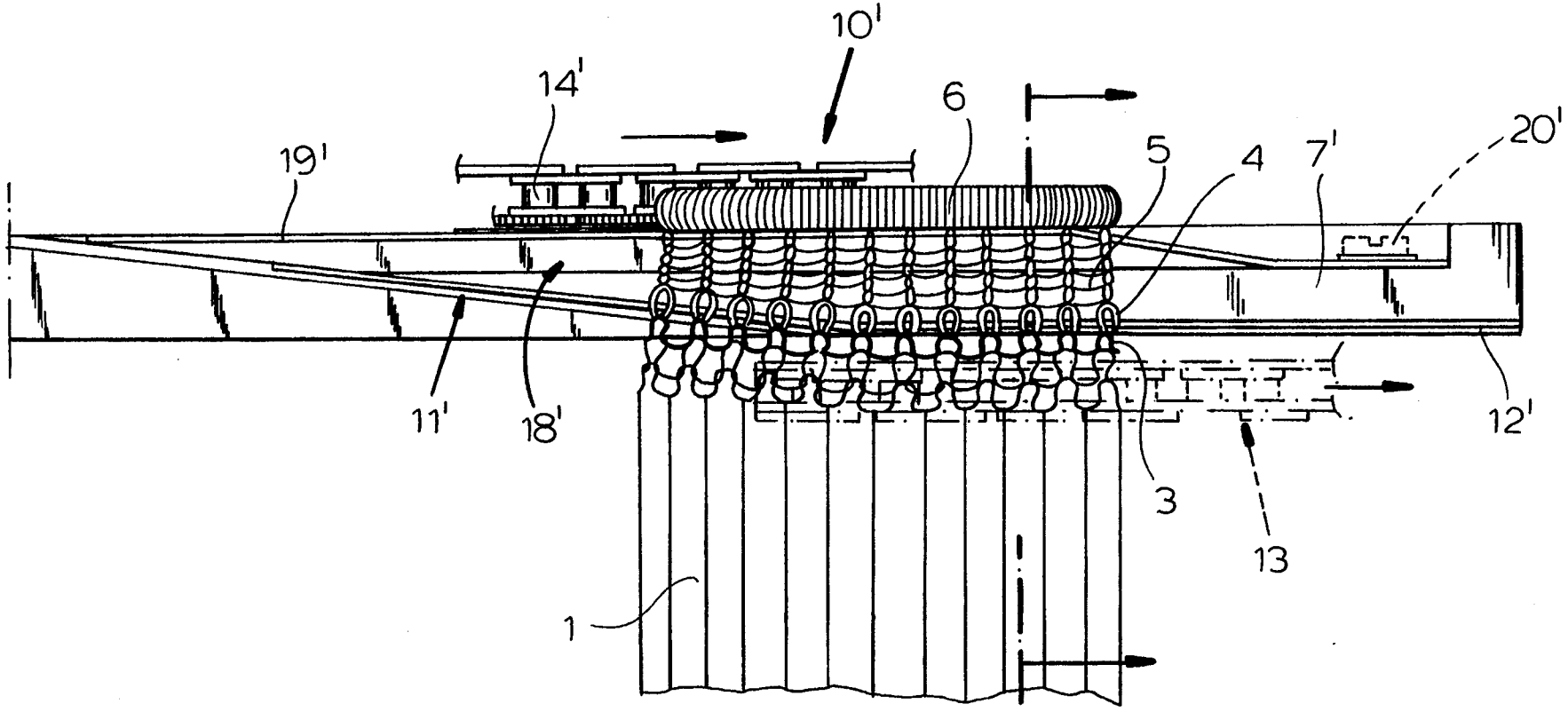
FIG. 5 is a sectional view similar to FIG. 4, showing the stocking shortly before it leaves the chain feeder.

When the manually introduced toe portion of the stocking reaches the position shown in FIG. 3, the two reinforced edges 6 are gripped by two toothed chains 10 and 10' of the feeder, whereby the toe portion is automatically moved in the direction of the feeder outlet. The mutually facing sides of bars 7 and 7' are designed as shown in FIG. 5 with rib segments 11, respectively 11' running obliquely downward and are separated by a slot whose width is smaller than the thickness of the two superposed layers of row 3 with the very tight stitches, followed by row 4 with wide stitches. As a result, when the toe portion is moved forward the tight-stitch row 3 lies always under the ribs 11 and 11' and the fine-stitch rows 5 are gradually stretched, and at a certain point—starting somewhere in the middle of the length of the oblique segment—the stitches of the wide-stitch row 4 start to enter the slot separating the ribs from each other; the stitches run into this slot as if they were guided on rails.

The oblique segments 11 and 11' of the ribs pass over into horizontal segments 12 and 12' whose underside is parallel with the upper side of bars 7 and 7' and are at a distance from this upper sides which is slightly smaller than the sum of the height of the wide-stitch row 4 and the fine-stitch row 5 in a stretched state. In this way, when using a feeder with 8 mm thick bars, this sum is equal to 7 to 8 mm.

The thickness of the ribs of the two segments 11, 11' and 12, 12' is in turn smaller than the height of row 4 with wide stitches and ranges only between 0.5 and 0.8 mm.

When the toe portion of the stocking reaches the area of the horizontal rib segments 12 and 12' it is seized by the feeder chains 13 of the looping machine and remains during the sewing positioned exactly on its wide row of stitches.

Figure 7:
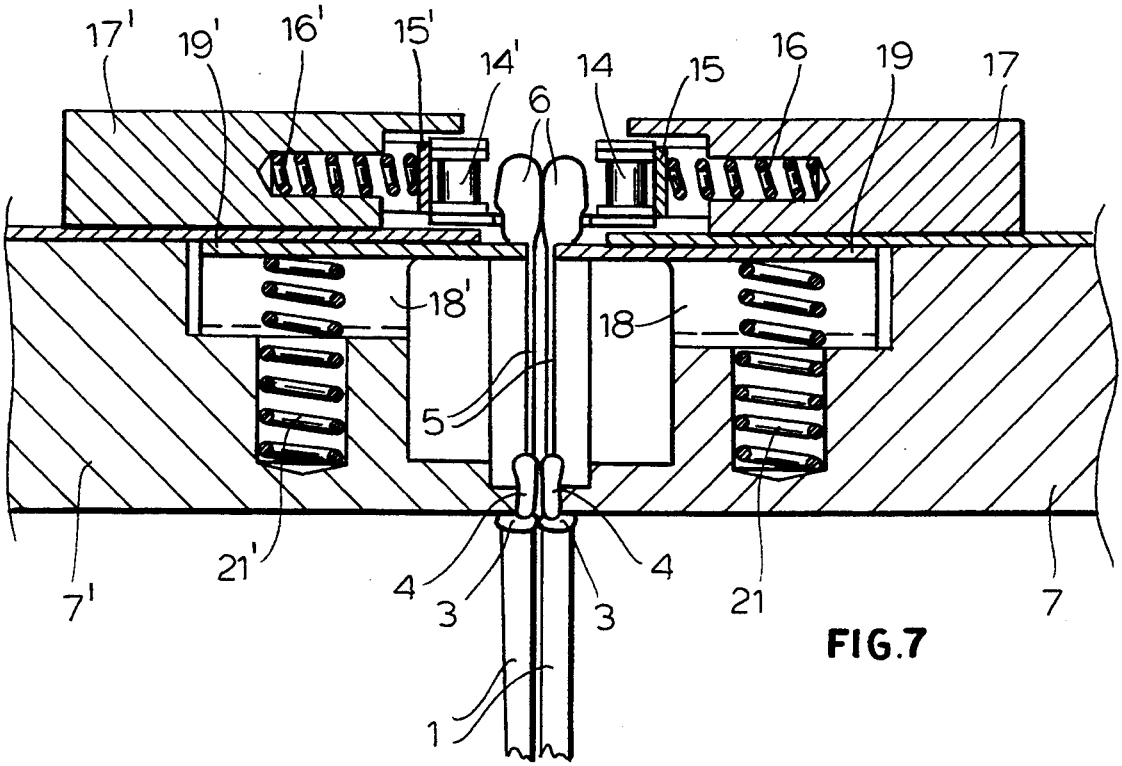
FIG. 7 is a sectional view in the plane VII—VII of FIG. 5.

The mutually facing sides 14, 14' of the toothed chains 10, 10' are spring-loaded as per FIG. 7, and namely over bars 15, 15' acted upon by small springs 16, 16' which are located under covers 17, 17' mounted on bars 7, 7'. This solution of double spring action makes possible a more accurate positioning of the layers of the stocking toe portion when the wide-stitch row 4 slides into the slot separating from each other the oblique rib segments 11, 11' formed in the mutually facing walls of the two bars 7 and 7', because the fabric is thus better adjusted to both sides.

In order to keep the fine-stitch row 5 of elastic yarn under constant slight stress and to even out the minor height difference between the fine rows of stitches on the side of the decreasing toe portion and the fine rows of stitches on the side of the heel, in the opposite walls of the bars 7 and 7, starting from the area where the oblique rib segments 11, 11' of the walls begin, recesses 18, or 18' are formed. The recesses are covered on top by lamellae 19, 19' made of spring steel of 0.3 to 0.4 mm thick. According to FIG. 8 the lamellae 19, 19' are fastened with screws 20, 20' to the bars so that the upper edges of their mutually facing margins align exactly with the corresponding upper edges of those segments of the mutually facing walls of bars 7 and 7' which lie before the mentioned area.

Figure 8:
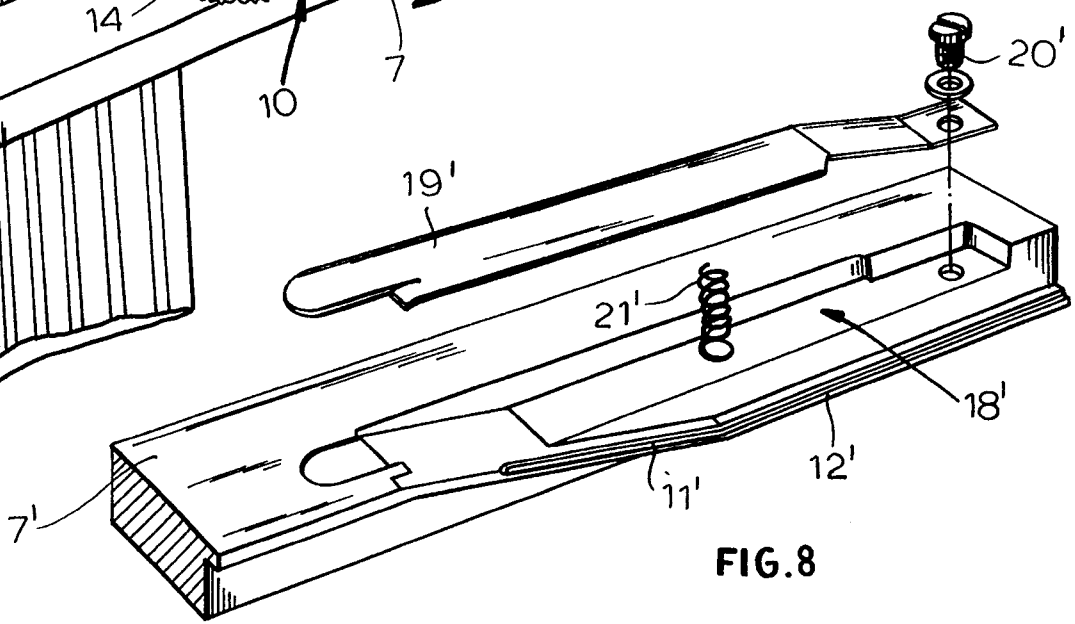
FIG. 8 is an exploded view of the bar indicated by arrow VIII in FIG. 3.
Figure 4:
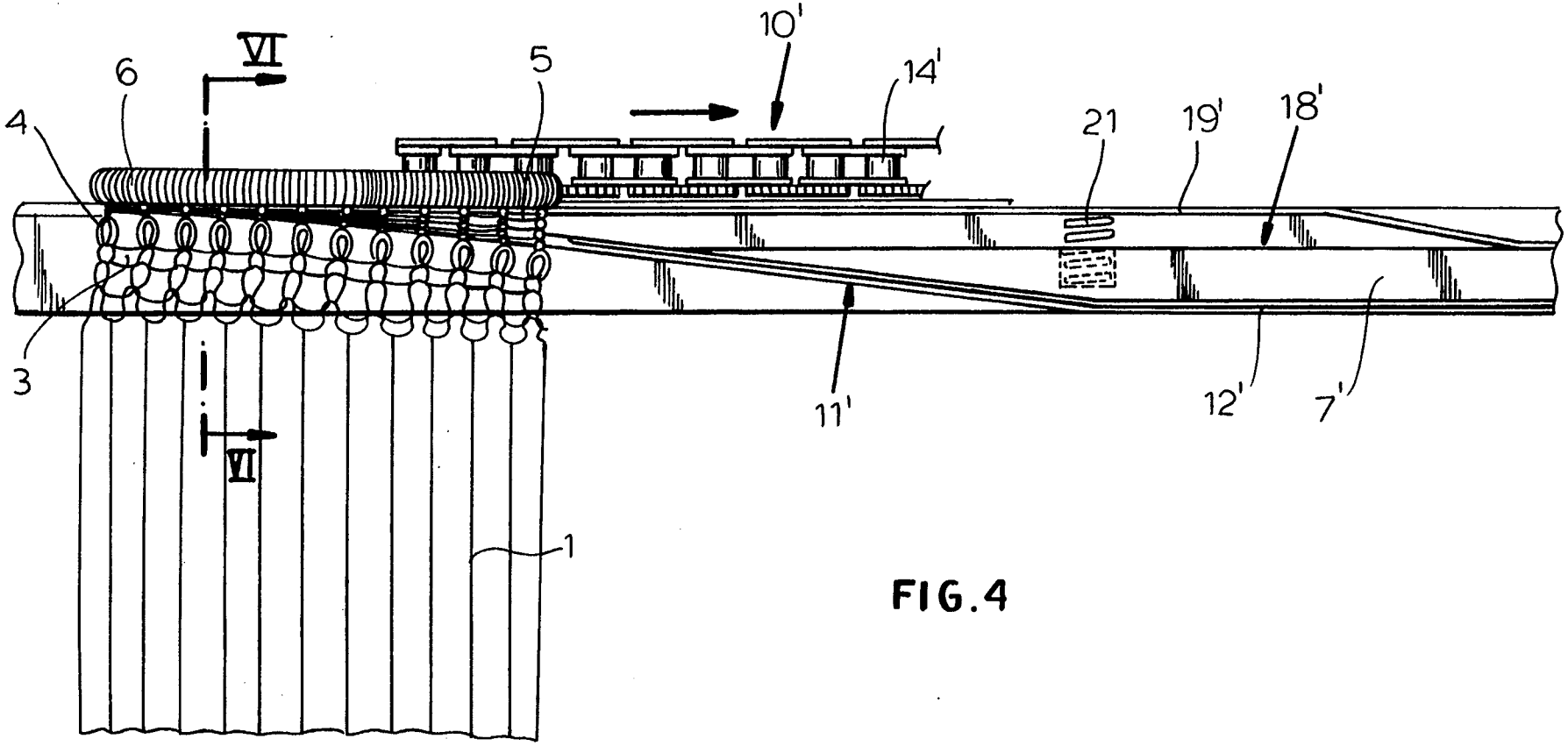
FIG. 4 is a sectional view in the plane IV—IV of FIG. 3.

In order to avoid an excessive flexibility of the lamellae, they are supported from underneath by small coil springs 21, 21' located in bores provided in the bottom of recesses 18 and 18' (compare FIGS. 7 and 8).

It is self-understood that within the framework of the invention concept modification can be made without leaving the patent protection. So for instance the widened thick area of the stocking which rests against the ribs, in order to stretch the fine-stitch rows 5, can be produced by placing before row 4 with wide stitches a row with reinforced stitches or by making the stocking of double yarn, while making the row 4 with wide stitches only of a simple yarn.

The flexibility of lamellae 16 and 16' could be adjustable by means of suitable stops with screws, in order to achieve an adjustment to the stocking to be sewn together.

We claim:

1. A process for feeding stockings produced in circular knitting machines for closing of the toe portion of the stocking in a looping machine with a chain feeder having two guide bars, comprises the steps of:

(a) knitting a stocking body forming a row of wide stitches following the stocking body and then forming subsequent rows of finer stitches of elastic yarn at the toe portion of the knitted stocking body;

(b) forming the subsequent rows using a yarn thicker than a yarn used for the stocking body in order to form a reinforced edge which rests from above against upper sides of the two bars of the feeder, the bars being mirror images of one another symmetrical with respect to a longitudinal median plane of the feeder and forming a slot wherein toe portion of the stocking to be sewn together is flattened and inserted;

(c) providing each bar with a longitudinal rib which is at a distance from the corresponding rib of the other bar and has an oblique segment starting at a certain distance from an inlet of the feeder and diverges downwardly with respect to the upper side of the respective bar so that a segment is formed which together with the opposite rib constitutes a slanted plane, interrupted by a longitudinal slot, the oblique segment of each rib passing over into a segment running parallel with the upper sides of the bars; and (d) forming a height of the wide-stitch row greater than a thickness of the ribs of the bars and a sum of the height of the wide-stitch row and of a height of the fine rows of elastic yarn, measured when the fabric is stretched, is at least equal to the thickness of bars, wherein the rows of wide stitches in the flattened stocking are superimposed through movement along the slanted plane as the stocking enters the slot and are guided on rails and the finer rows of elastic yarn are gradually stretched.

2. The process according to claim 1 wherein the row of wide stitches follows a row of tight stitches knitted with the same yarn as the stocking body.

3. The process according to claim 1 further comprising knitting a row with reinforced stitches following the row of wide stitches.

4. The process according to claim 1 further comprising knitting the last row of wide stitches being of a single yarn when the stitches of the stocking are knit of a double yarn.

5. A chain feeder for a looping machine for closing a toe portion of a stocking, comprising two bars which are mirror images of each other symmetrical to a median longitudinal plane of the feeder and which form a slot wherein a folded toe portion of the stocking to be sewn is introduced, each bar has a longitudinal rib at a distance from a corresponding longitudinal rib of the opposite bar and a first segment starting at a certain distance after an inlet of the feeder and diverging downwards with respect to an upper side of the bar forming a segment which together with the opposite rib form a slanted plane interrupted by a slot, wherein the first segment of each rib passes into a second segment running parallel to the upper sides of the bars, and wherein a thickness of the ribs is smaller than a height of wide stitches which are formed at an end of the stocking toe portion.

6. The feeder according to claim 5 wherein the thickness of the ribs is 0.5 mm.

7. The feeder according to claim 5 wherein mutually facing sides of both chains are pressed towards median longitudinal plane of the feeder by elastic means.

8. The feeder according to claim 5 wherein for stretching rows of stitches made of elastic yarn, in the bars starting from a area where oblique segments of the guide ribs begin, recesses are provided, which are open in the direction of the median longitudinal plane of the feeder and are upwardly covered by lamellae consisting of spring steel band of 0.3 to 0.4 mm thick and whose mutually facing margins are aligned with the upper edges of inner side walls of the bars.

9. The feeder according to claim 8, further comprising means for setting degrees of elasticity of the lamellae.

* * * * *